US007520508B2

(12) United States Patent
Redd

(10) Patent No.: US 7,520,508 B2
(45) Date of Patent: Apr. 21, 2009

(54) BOARD GAME APPARATUS FOR TEACHING ELECTORAL COLLEGE, HISTORICAL AND GEOGRAPHICAL CONCEPTS

(75) Inventor: Cathy Redd, Washington Crossing, PA (US)

(73) Assignee: Bright Red Ideas, LLC, Washington Crossing, PA (US)

( * ) Notice: Subject to any disclaimer, the term of this patent is extended or adjusted under 35 U.S.C. 154(b) by 83 days.

(21) Appl. No.: 11/465,644

(22) Filed: Aug. 18, 2006

(65) Prior Publication Data

US 2007/0040329 A1 Feb. 22, 2007

Related U.S. Application Data

(60) Provisional application No. 60/709,927, filed on Aug. 19, 2005.

(51) Int. Cl.
*A63F 3/00* (2006.01)

(52) U.S. Cl. ..... 273/257; 273/243; 273/157 A; 434/150

(58) Field of Classification Search ..... 273/254, 273/257, 302, 308, 153 R, 157 A; 434/130, 434/150

See application file for complete search history.

(56) References Cited

U.S. PATENT DOCUMENTS

| | | | | | |
|---|---|---|---|---|---|
| 753,949 | A | | 3/1904 | Wing | |
| 1,547,237 | A | * | 7/1925 | Ropp | 273/302 |
| 1,616,216 | A | * | 2/1927 | Dempsey | 273/279 |
| 1,665,516 | A | * | 4/1928 | Tuttle et al. | 273/254 |
| 1,745,946 | A | * | 2/1930 | Murray | 273/296 |
| 1,907,255 | A | | 5/1933 | Ferrari, Jr. | |
| 2,043,482 | A | | 6/1936 | Lord | |
| 2,848,823 | A | * | 8/1958 | Washburn | 434/170 |
| 2,930,621 | A | * | 3/1960 | Gross et al. | 273/257 |
| 3,318,607 | A | * | 5/1967 | Wilson | 277/340 |
| 3,368,816 | A | * | 2/1968 | Milazzo et al. | 273/257 |
| 3,512,779 | A | * | 5/1970 | McGaughey, Jr. | 273/275 |
| 4,085,938 | A | * | 4/1978 | Bean, Jr. | 273/279 |
| 4,092,028 | A | | 5/1978 | Marse | 273/239 |
| 4,118,036 | A | * | 10/1978 | Marse | 273/257 |
| 4,216,967 | A | | 8/1980 | Marse | 273/257 |
| 4,643,429 | A | * | 2/1987 | Crandon et al. | 273/251 |
| 4,988,108 | A | * | 1/1991 | Shepard | 273/254 |
| 5,288,076 | A | * | 2/1994 | Jackson et al. | 273/279 |
| 5,374,066 | A | * | 12/1994 | Ali | 273/279 |
| 5,624,120 | A | | 4/1997 | Frank-Opigo | 273/279 |
| 5,660,390 | A | * | 8/1997 | Ginzburg et al. | 273/257 |
| 5,690,336 | A | * | 11/1997 | Oliver | 273/302 |
| 6,302,397 | B1 | * | 10/2001 | Al-Shanfa | 273/292 |
| 6,598,880 | B2 | * | 7/2003 | Addabbo | 273/306 |
| 7,314,217 | B1 | * | 1/2008 | Dick | 273/257 |

* cited by examiner

*Primary Examiner*—William M. Pierce

(57) ABSTRACT

A game includes a board displaying a map showing cartographic outlines of the U.S. states, and optionally each state's capital. The game includes at least one deck of cards including a respective card for each state shown on the game board. Geography playing cards include an image and/or identifying text for each state. Electoral college playing cards are similar but further include text identifying each state's number of electoral college votes, and optionally, capital. The game may further include a state capital overlay obscuring or providing state capital names, and/or a historical map overlay for showing as available only the states of the union in an associated election year. Historical playing cards, similar to the electoral college or geography playing cards, corresponding to each historical map overlay may also be provided. A workbook including stimulating topical questions may also be provided.

13 Claims, 10 Drawing Sheets

FIG.2
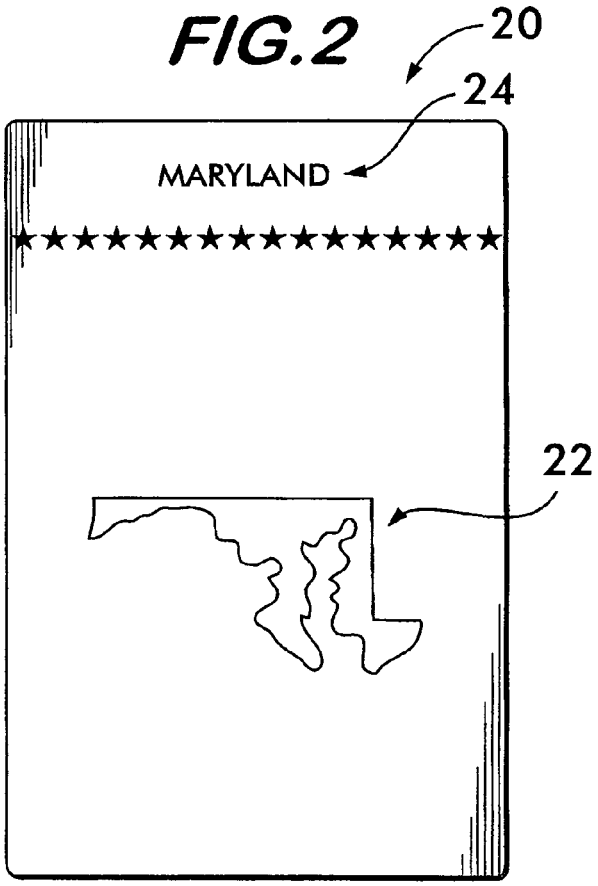
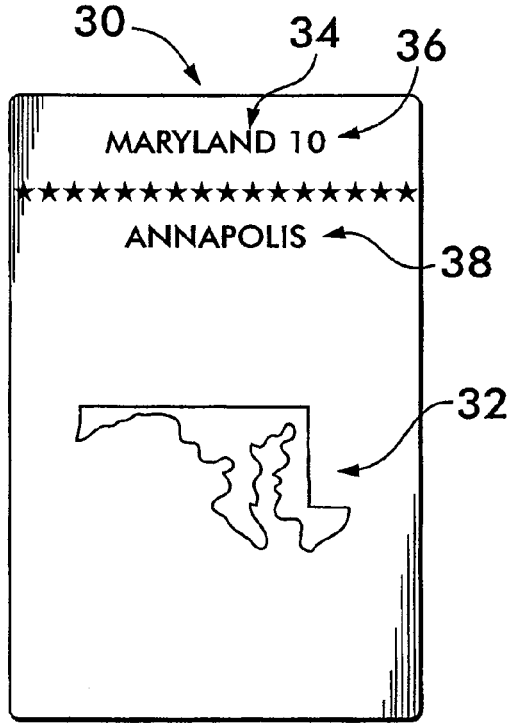
FIG.3

BOARD GAME APPARATUS FOR TEACHING ELECTORAL COLLEGE, HISTORICAL AND GEOGRAPHICAL CONCEPTS

CROSS-REFERENCE TO RELATED APPLICATION

This application claims the benefit of U.S. Provisional Patent Application No. 60/709,927, filed Aug. 19, 2005, the entire disclosure of which is hereby incorporated herein by reference.

FIELD OF THE INVENTION

The present invention relates generally to board games, and more particularly to an entertaining board game for teaching electoral college concepts, national history, and geographical information.

DISCUSSION OF THE RELATED ART

Various presidential election games are known in the art. Generally, these games allow players to compete for the Presidency of the United States, or are otherwise based on electoral college concepts. However, many of these games are directed toward young adults, making them unsuitable for children and young students. Further, many of these games fail to challenge adults. Further still, while existing games may provide limited exposure to electoral college concepts, they fail to engage players in a manner stimulating memory recall and learning retention. Finally, existing games are static in nature, and fail to teach the impact of the dynamic nature of the electoral college system and its role over time in national history.

SUMMARY OF THE INVENTION

An embodiment of the present invention provides a gameboard based apparatus for teaching the geography of the United States, state and state capital information, national history of state status across multiple distinct historical time periods, the operation of the electoral college system, and/or the evolution across multiple distinct historical time periods of the role of the electoral college in presidential elections. The game is suitable for inclusion in a teaching students in classroom environments. Further, the game is configured for multiple modes of play, ranging in difficulty from low, to medium, to high, to allow the game to be used as a teaching tool for individuals with various levels of knowledge and ability. As a result, it is versatile in application and challenging across multiple age groups.

A map of the United States is presented as a playing surface for teaching the states to early elementary grades, and for teaching the dynamics of the electoral college across history to older students and adults. While the principles of the exercises are simple to grasp, they offer opportunities to gain information about key content areas relevant to elementary school curriculum settings, citizenship courses, and cognitive skills enhancement. The game is specially configured to encourage players to practice effective memory strategies, deductive reasoning, mental addition, and basic social skills.

At least one mode of play of the game is relatively simple and easily mastered by a variety of student populations including children ages six and up, as well as adults of all ages. The game's content is useful in elementary social studies and geography curricula and United States citizenship courses. It is particularly well-suited to home-school settings. In some cases, the game works well in high school and remedial college classes. The rules of game play are simple enough to be easily understood by young children and the content and strategies are challenging enough to be enjoyed by adults. While social time is spent, accessible and appropriate challenges are enjoyed, and valuable learning takes place. Information mastered will be immediately useful in a variety of ways in academic and non-academic settings. Geography, social studies, arithmetic, English as a second language, and citizenship classes are settings in which the game's material is directly relevant. The learning format is enjoyable and efficient. The challenges provide enough detail to hold the attention of many students regardless of age.

In one embodiment of the present invention, the game apparatus includes: a game board having an image of a current map of the United States, the map showing each state, district or territory (collectively "state"), each state's capital and respective border/shape, the game board excluding any visible indication of any number of electoral college votes corresponding to any state; a set of geography playing cards, the set of geography cards comprising one card for each state shown on the game board, each card having an image depicting the shape of a respective states, and text indicating the state's name; a set of electoral college cards, the set of electoral college cards comprising one card for each state shown on the game board, each card having an image depicting the shape of a respective states, text indicating the state's name, text indicating the name of the state's capital, and numerical indicia indicating the number of electoral college votes held by that state in a year corresponding to the current map shown on the game board; a state capital overlay obscuring the capital names or, alternatively, a secondary playing board like the previously described board, but without the state capitals text presented, at least one historical map overlay, the historical map overlay corresponding to a particular election year and bearing numerical indicia identifying that election year, the historical map overlay being configured to obscure, or otherwise indicate as unavailable, a selected plurality of states shown on the game board, said overlay cooperating with same game board to identify as available a subset of the states shown on the game board; and a set of historical playing cards corresponding to each map overlay, the set of historical playing cards comprising one card for each state shown as available on the game board after application of the map overlay, each card having an image depicting the shape of a respective states, text indicating the state's name, numerical indicia identifying an election year, and numerical indicia indicating the number of electoral college votes held by that state in that election year, and optionally text indicating the name of the state's capital.

Optionally, a plurality of map overlays are provided, a plurality of corresponding sets of electoral college cards are provided, tokens for marking states as unavailable are provided, and a score sheet are provided. A workbook comprising textual questions for stimulating thought and furthering learning may also be provided.

A method of playing a game in accordance with the present invention involves: dealing to each player a selected number of cards from a set of cards, each player seeking to gather a group including a selected number of cards representing contiguous states shown on a game board/overlay combination by asking other players for cards or by drawing cards from the set, accumulating the group of state cards and laying such cards aside, and continuing to draw state cards from other players and the set to accumulate groups of cards until one player no longer holds any cards. Optionally, each player recalls from memory a number of electoral votes corresponding to a state before asking another player for that state's card, and/or requests a state by identifying the state's capital by name, and/or by identifying both the state and the state's capital by name. Optionally, the game is played repeatedly for different historical periods.

In the Beginner mode of play, play proceeds in a manner similar to that described above. Preferably, two adjoining states are considered a group at this level. In one embodiment, a basic set of cards (see FIG. 2), in which each card includes only a state image and state name, is used for this level of play. In this embodiment, a winner of the game is determined by adding the number of cards, or numbers of groups, laid aside by each player. This requires relatively simple counting/addition skills.

In an alternative embodiment, another set of cards (see FIG. 3), in which each card includes a state image, state name, and number of electoral college votes, is used. In this embodiment, a winner of the game is determined by summing the number of electoral college votes held by the states represented by the cards laid aside by each player. This requires greater addition skills, and may be selected when appropriate for the players of a particular game.

BRIEF DESCRIPTION OF THE DRAWINGS

The present invention will now be described by way of example with reference to the following drawings in which:

FIG. 2 is a plan view of an exemplary geography playing card of a type used in an exemplary Beginner mode of instruction in accordance with the present invention;

FIG. 3 is a plan view of an exemplary electoral college card of a type used in an exemplary Beginner, Intermediate, or Advanced mode of play in accordance with the present invention;

FIGS. 4A-5C are plan views of exemplary historical playing cards of a type used in an exemplary Historical mode of play in accordance with the present invention.

DETAILED DESCRIPTION OF THE PREFERRED EMBODIMENTS

An embodiment of the present invention allows for multiple modes of play. While any combination of the components discussed below may be gathered together for sale as a game board apparatus in kit or other form for any one or more of the multiple modes of play, preferably all elements are sold as a single game board apparatus capable of being used for multiple modes of play.

Figure 1:
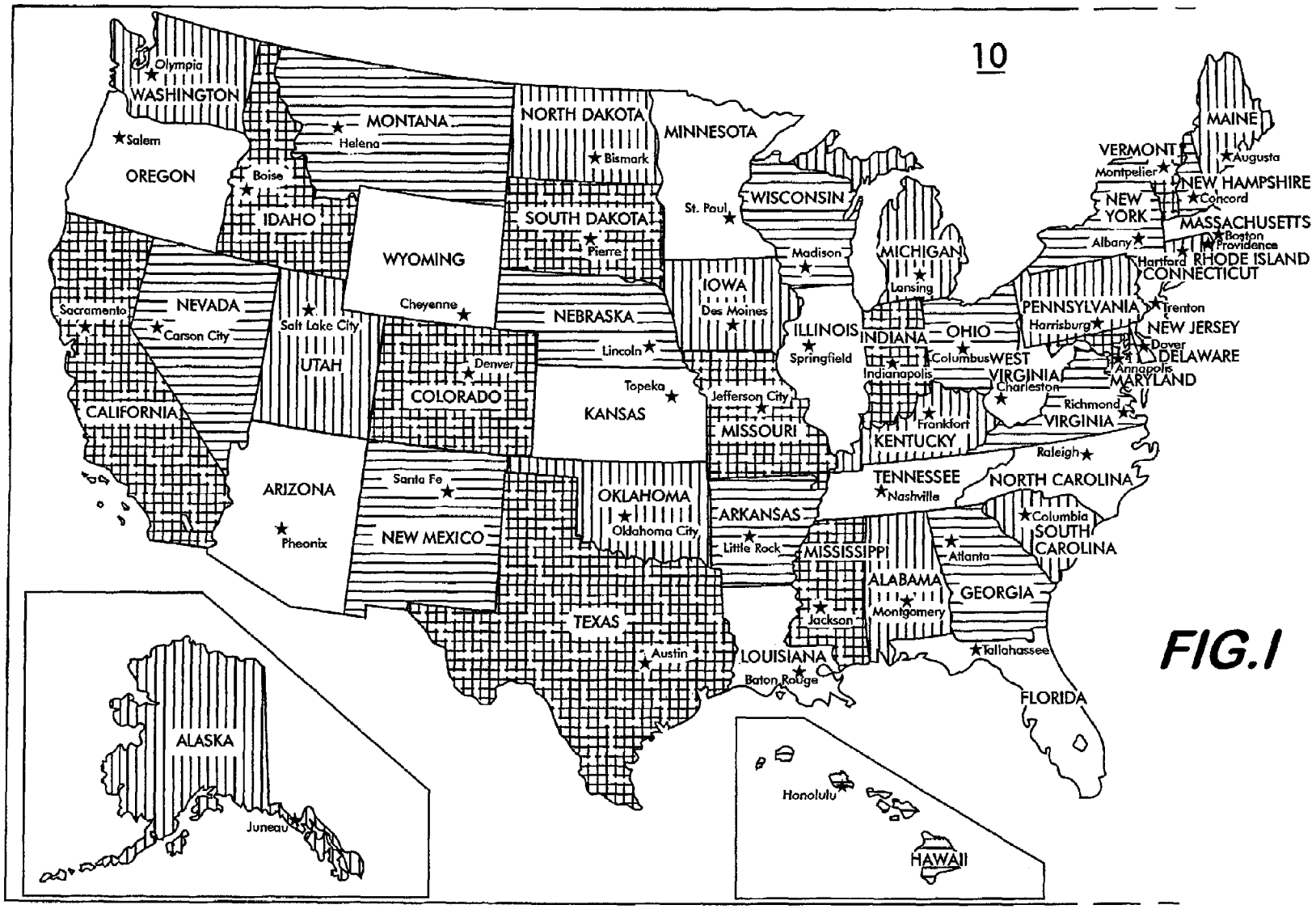
FIG. 1 is a plan view of a game board in accordance with an exemplary embodiment of the present invention.

Referring now to FIG. 1, a preferred embodiment of the game board apparatus includes a game board 10 bearing a current (e.g., year 2000) graphical depiction of a map of the United States. Preferably, the map image is a printed image supported on a relatively rigid foam board or cardboard, etc. The map image shows one or more of state borders/boundaries, state names, state capital names, and state capital locations. Adjacent states are preferably shown in different colors, e.g., by filling each state's border with a colored background, as shown in FIG. 1. Topographical features are preferably excluded for simplicity. Further, the number of electoral college votes held by each state for the year of the map preferably is excluded from, i.e. not printed on, the game board 10. This enhances memory retention of electoral college vote information, as discussed in greater detail below.

The game apparatus also includes at least one set of playing cards for use in playing the game. Each set includes one playing card corresponding to each state and voting district (collectively "state") shown on the game board (or shown after application of an overlay, as discussed below), e.g. 51 cards for a year 2000 map (50 states and the District of Columbia). Several different types of sets of playing cards are provided.

FIG. 2 is a plan view of an exemplary geography playing card 20 of a type used in an exemplary Beginner instructional mode in accordance with the present invention. As shown in the exemplary card 20 of FIG. 2, each geography playing card 20 includes an image 22 depicting the shape/border of one of the respective states (Maryland in FIG. 2), preferably in a color corresponding to its color on the game board 10. Each card preferably further includes text 24 indicating the associated state's name. This is a basic card configuration, and is suitable for teaching national geographical information during a Beginner mode of play.

FIG. 3 is a plan view of an exemplary electoral college card 30 of a type used in an exemplary Beginner, Intermediate, or Advanced mode of play in accordance with the present invention. Each electoral college card and set of electoral college cards for use in these play modes is similar to the cards and card sets described above with reference to FIG. 2 in that each card 30 of the electoral college card set includes an image 32 depicting the shape of one of the respective states (Maryland in FIG. 3), preferably in a color corresponding to its color on the game board 10, and text 34 indicating the state's name. Unlike the geography playing card of FIG. 2, the electoral college card of FIG. 3 further includes numerical indicia 36 indicating the respective state's number of electoral college votes for a particular year corresponding to the set of cards, and textual indicia 38 indicating the name of the capital for the state shown. Such cards are suitable for use in Intermediate and Advanced play modes, which are particularly suited to teaching electoral college voting concepts and information, and state capital information.

Figures 4A, 4B, 4C, 5A, 5B, 5C:
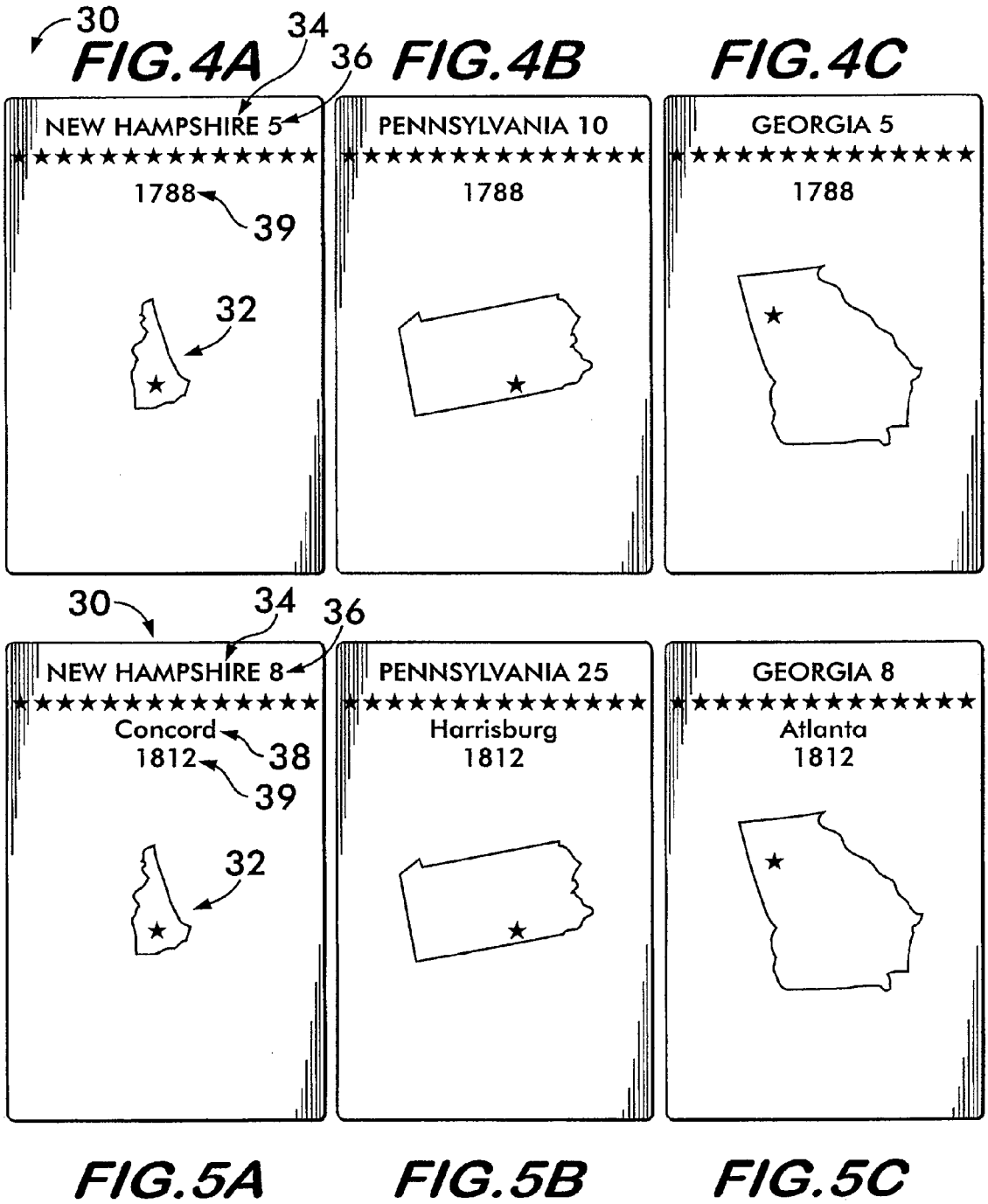

It should be noted that the game board apparatus preferably includes one or more sets of historical cards. Each historical card includes an image 32 depicting the shape of one of the respective states, preferably in a color corresponding to its color on the game board 10, and text 34 indicating the state's name. The historical playing card of FIG. 3 further includes numerical indicia 36 indicating the respective state's number of electoral college votes for a particular year corresponding to the set of cards. Optionally, each historical playing card includes textual indicia 38 indicating the name of the capital for the state shown, as shown in FIGS. 5A-5C, and numerical indicia 39 indicating the election year to which the cards correspond, as shown in FIGS. 4A-5C. Such historical cards are suitable for use in Intermediate and Advanced play modes, which are particularly suited to teaching electoral college voting concepts and information, and state capital information.

More specifically, each set of historical playing cards corresponds to one of several different historical time periods. Preferably, election years of 1788, 1812, 1860, 1900, 1948 and 2000 are selected as the different historical time periods, and one set of cards reflecting historically accurate electoral college vote information is provided for each period. For example, cards 30 shown in FIGS. 4A and 5A show that New Hampshire had 5 electoral college votes in the year 1788, and 8 electoral college votes in the year 1812. It should also be noted that the number of states (and thus cards) for the time periods varies, and each set of cards is customized accordingly. Such sets of cards are suitable for use in a Historical mode of play, in accordance with game play described below for the Intermediate and Advanced play modes. Such sets of cards are useful to further teach the national state history and the role and impact of the electoral college system over a span of national history.

The game board apparatus preferably further includes a plurality of historical map overlays 50 (year 1788), 60 (year 1812), 70 (year 1860), 80 (year 1900), 90 (year 1948), etc., as shown in FIGS. 6-10. Each historical map overlay 50, 60, 70, etc. is configured to fit over and/or attach to the game board, and to obscure, or otherwise indicate as unavailable, a selected plurality of states shown on the game board 10 of FIG. 1, which represents the state of the union in the year 2000. Preferably, each historical map overlay includes numerical indicia 52 indicating the year to which it applies. Each historical map overlay 50, 60, 70, etc. is specially configured to block out or otherwise mark as unavailable a respective subset of all states to correspond to the state of the union in a respective year. Accordingly, when a historical map overlay for a particular year is applied to the game board 10, only the states shown in the year corresponding to the overlay are readily visible or designated as available for play. Collectively, the historical map overlays provide views of the states of the country in the years 1788, 1812, 1860, 1900, and 1948, the original game board (without an overlay) representing the year 2000, to correspond to the years selected for the historical playing cards. Thus, there is a game board/overlay combination for each of the years and sets of cards referenced above. These exemplary election years are selected for their historical significance and to show variations in the electoral college voting structure over time, however, any year or years may be selected, as desired.

Figure 6:
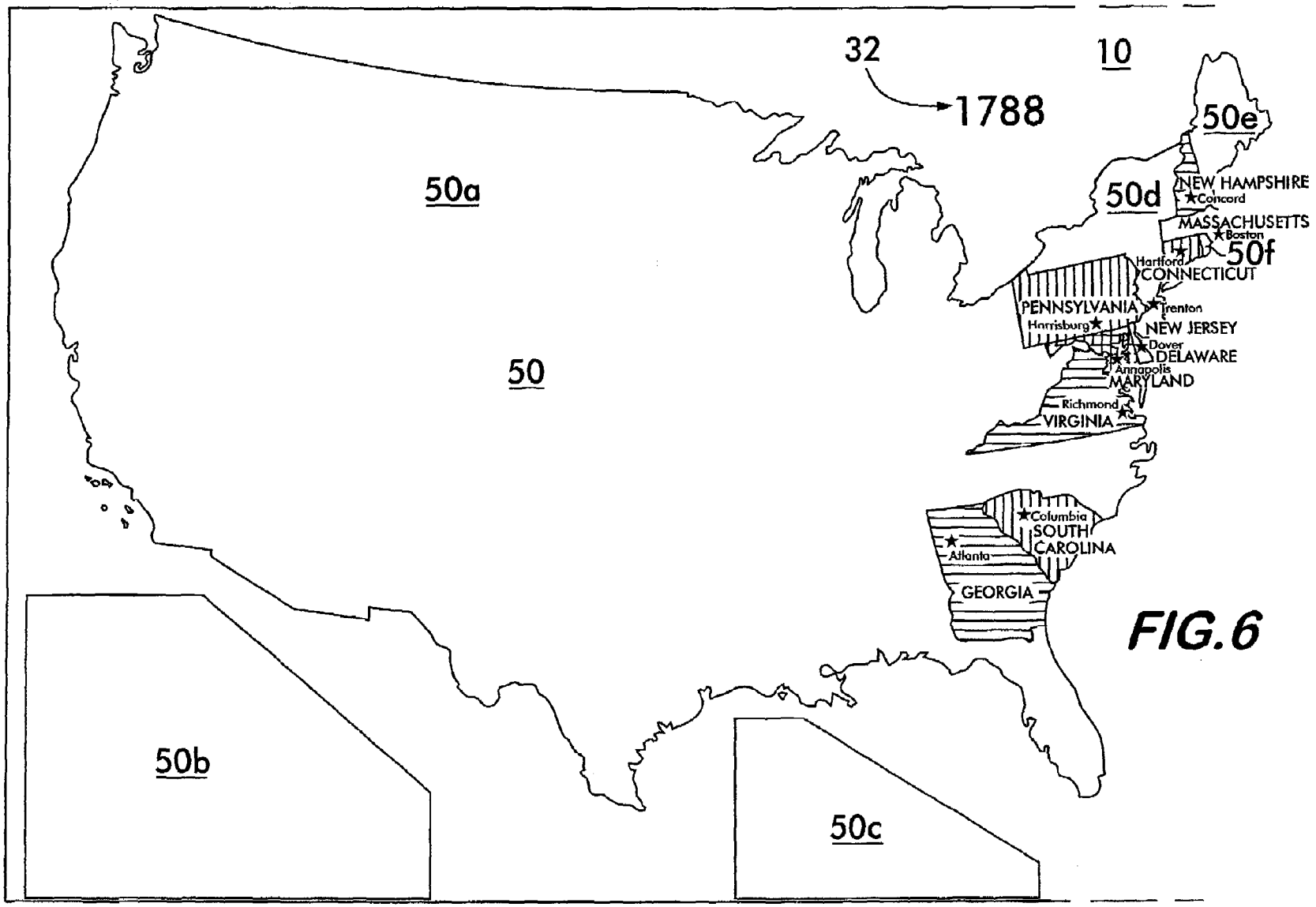
FIGS. 6-10 are plan views of exemplary historical map overlays used in conjunction with the game board of FIG. 1 during a Historical mode of play in accordance with the present invention.
Figure 7:
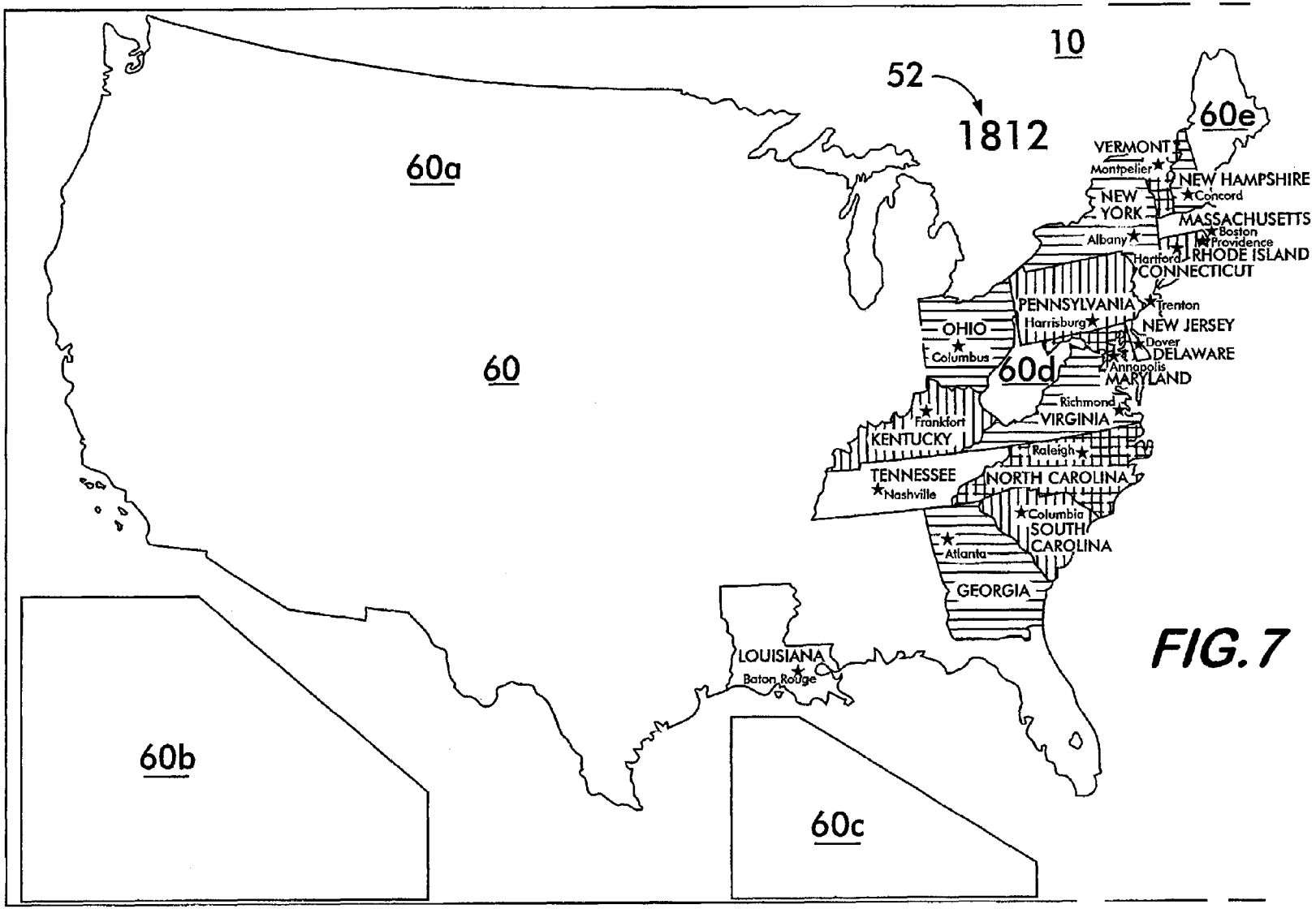
Figure 8:
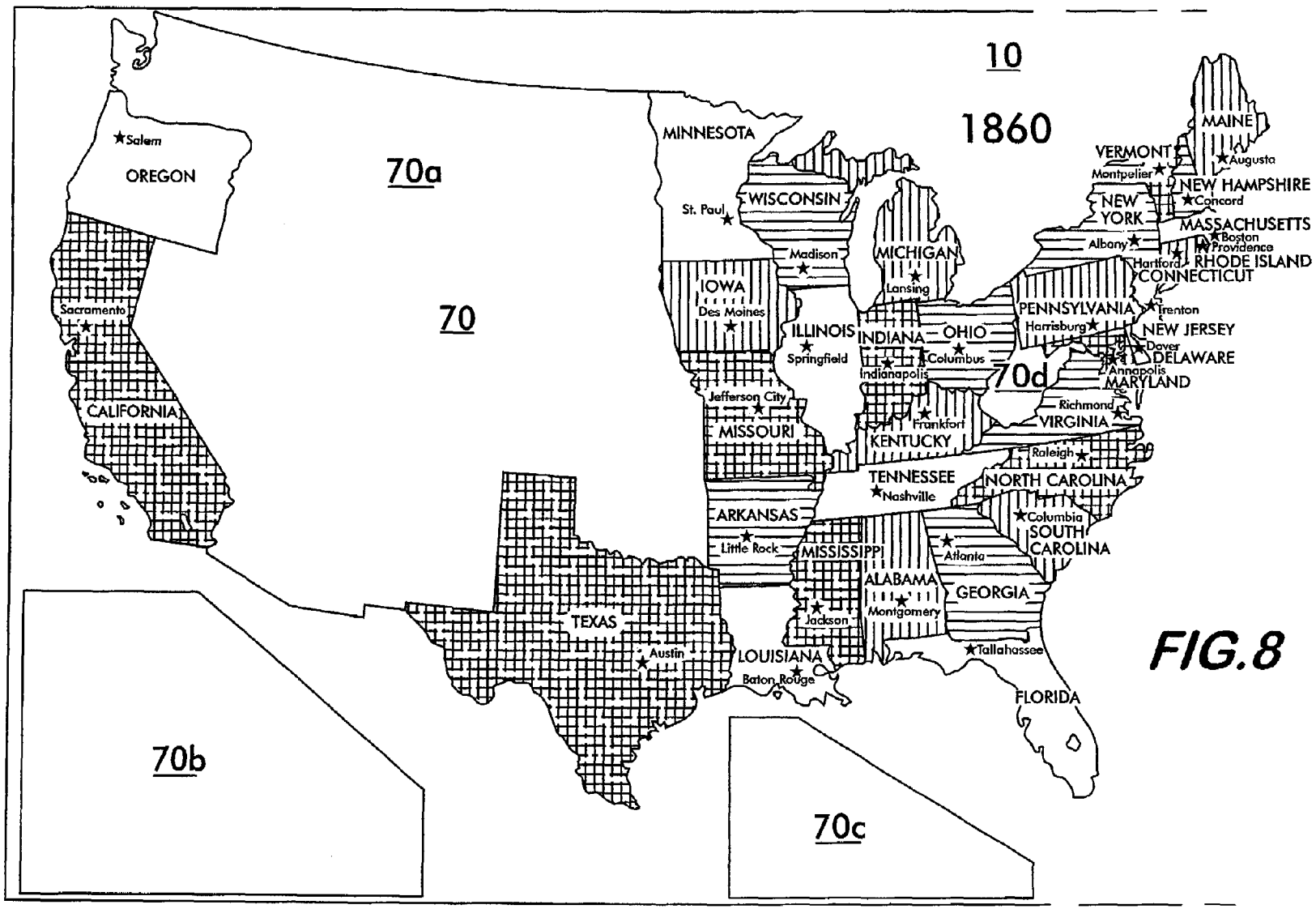
Figure 9:
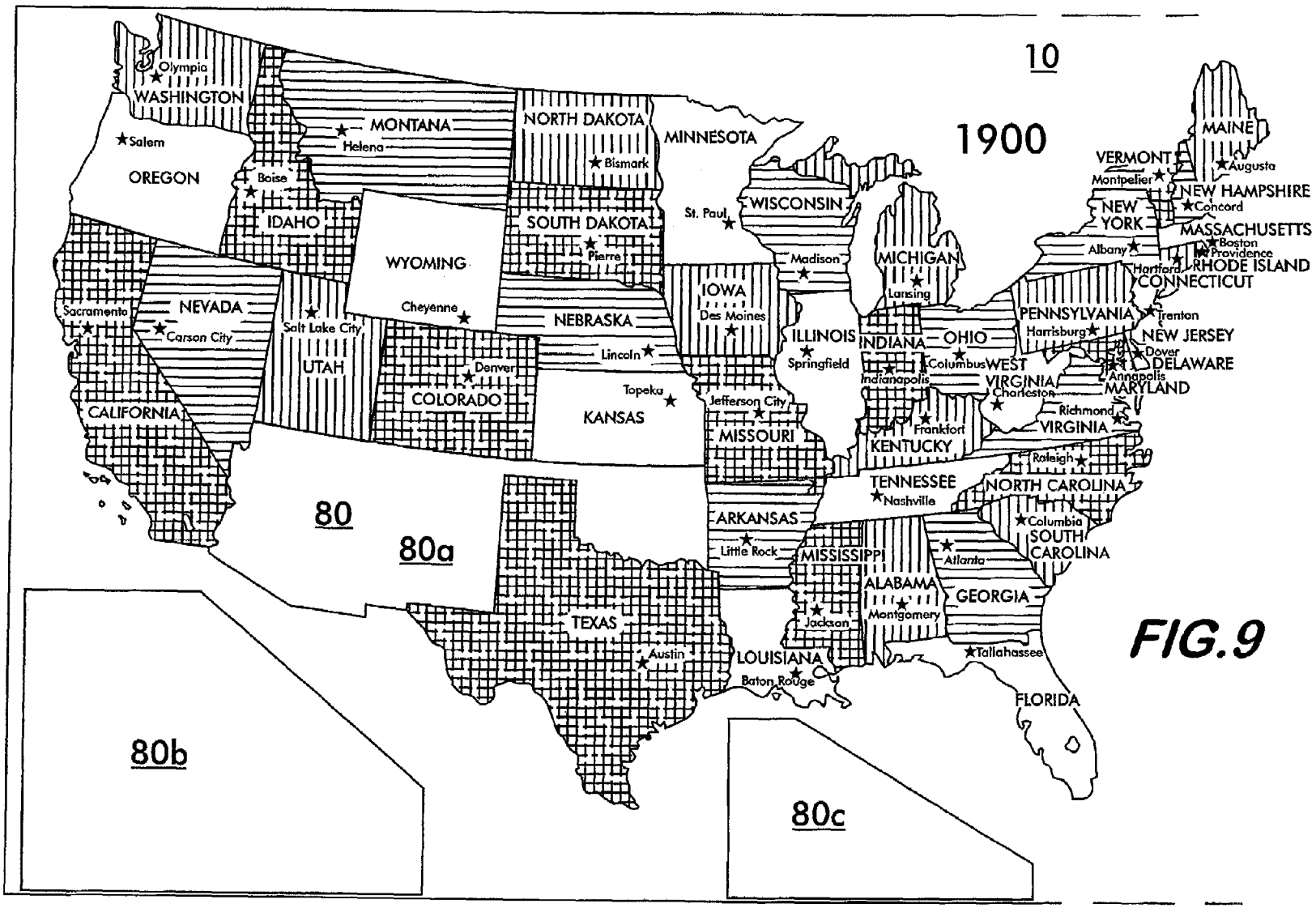
Figure 10:
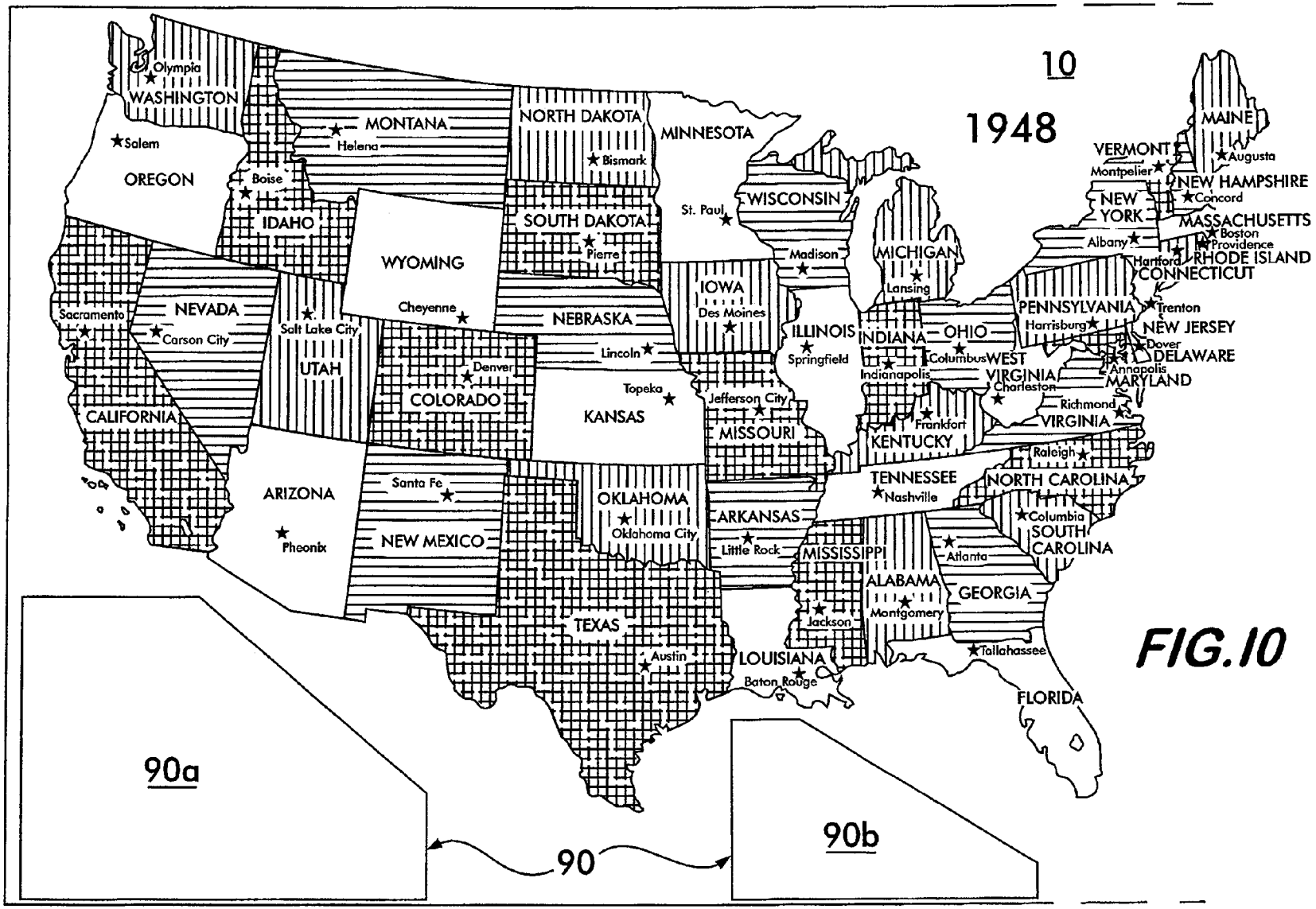

By way of example, each historical map overlay 50 may be configured as one or more discrete tiles 50*a*, 50*b*, 50*c*, 50*d*, 50*e*, 50*f* having shapes/borders to selectively obscure or otherwise mark certain states as available/unavailable, such that a certain subset of the states of the game board are shown as corresponding to a particular year to which the overlay corresponds. For example, the tiles may be cut out forms of paper, cardboard, vinyl or non-slip backed cardboard shapes placed on the board surface obscuring the geographic areas which were not part of the Union at the time of a specific election selected, as best shown in FIGS. 6-10. For example, the tiles 50*a*, 50*b*, 50*c*, 50*d*, 50*e*, 50*f* of overlay 50 for the year 1788 will obscure all states except Connecticut, Delaware, Georgia, Maryland, Massachusetts, New Hampshire, New York, New Jersey, Pennsylvania, South Carolina, and Virginia, these states being the only states in the year 1788, as shown in FIG. 6. In addition, suggested lesson plan text of an associated workbook may draw attention to historically different and/or disputed state boundaries at the time of selected elections in United States history. In the case of the 1788 election, disputes or nondeclaration involved the states as yet unnamed of Maine, Vermont, Rhode Island, Kentucky, West Virginia, and North Carolina.

Figure 11:
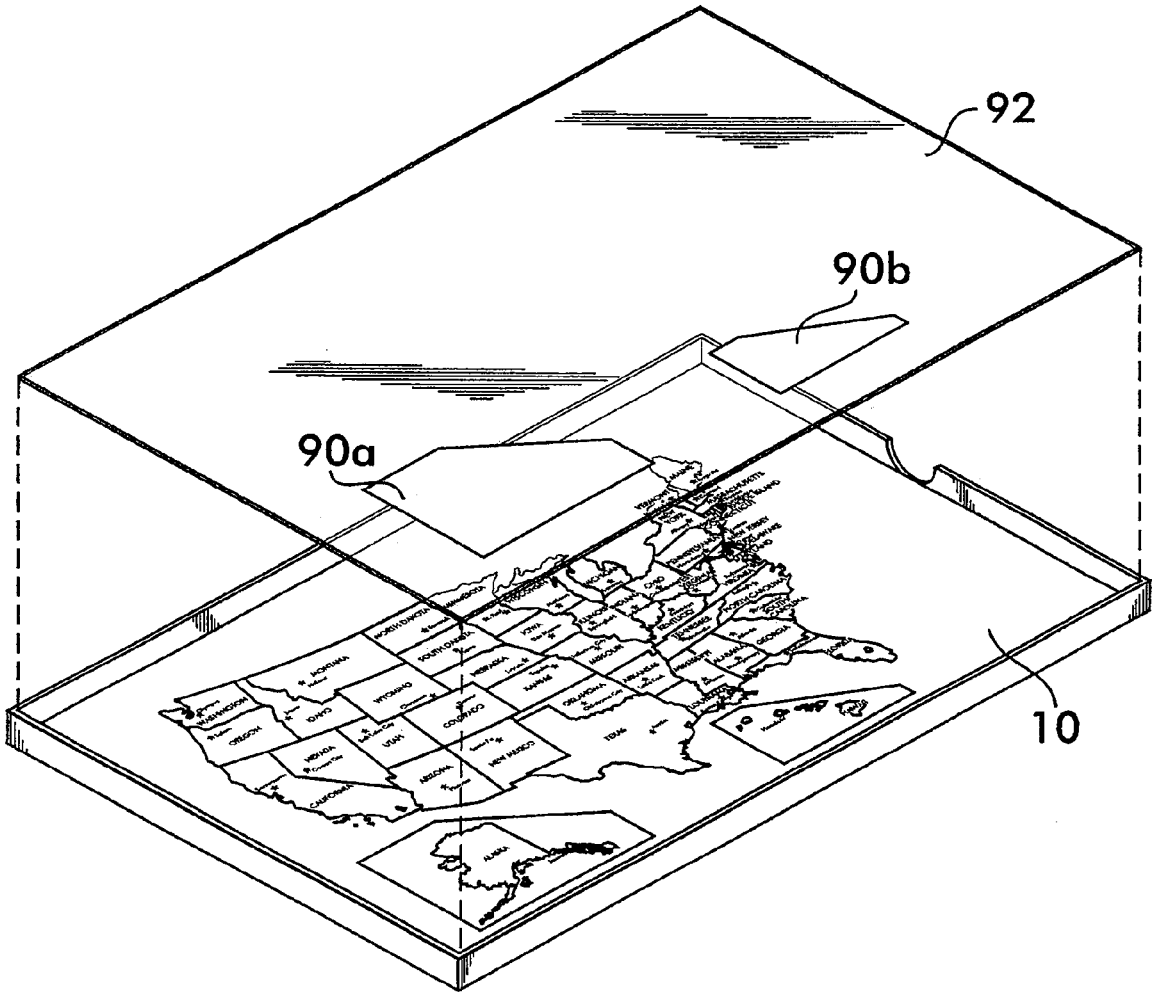
FIG. 11 is a plan view of an alternative embodiment of an exemplary historical map overlay used in conjunction with the game board of FIG. 1 during a Historical mode of play in accordance with the present invention.

Alternatively, as shown in FIG. 11, an alternative embodiment of a historical map overlay is a sheet 92 of transparent material bearing shaded areas 92*a*, 92*b* (this exemplary overlay sheet 92 corresponding to overlay 90 and tiles 90*a* and 90*b*). The shaded areas have a shape, border, and/or location selectively positioned to mark as either available or unavailable, a set states that so that it is readily apparent which states were part of the Union at the time of a specific election selected (to which the overlay corresponds, e.g. 1948. The sheet is preferably sized to correspond to the dimensions of the game board 10 so that the edges of the game board and overlay 92 may be easily aligned to ensure proper positioning of the shaded areas 92*a*, 92*b* over the intended states of the game board 10, as shown in FIG. 11.

The game apparatus may also include score sheets marked with a grid for facilitating tallying of penalty scores for the advanced forms or play, and/or tokens, such as opaque plastic discs, for marking states claimed and/or removed from play.

Game Play Overview

Components of the game apparatus can be used to play a game in accordance with one or more modes of play. For each mode of play, several individuals, e.g. two to four students, may play together. The method of playing the game is as follows. The game board 10 is positioned on a table, etc. and the players gather around the game board 10. Each player is dealt a hand of cards from a selected one of the sets of cards, the particular one of the sets of cards depending upon which mode of play is desired, as discussed in greater detail below. The remaining sets are set aside and are not used during play of a particular round of the game. Preferably, the hand includes seven cards dealt from the set. The remaining cards of the set are placed face down on the game board within reach of the players. Play proceeds in a round-robin fashion, preferably beginning with the player to the left of the dealer and proceeding in a clockwise direction. When it is a particular player's turn, that player selects one of the other players, and asks the other player for a card representing a specific state, e.g. Maryland, that shares a border with a state represented by a card held in the particular player's hand, e.g. Delaware. If that other player has the requested card, the requested card is given to the requesting player. The requesting player may continue to request states until the student queried does not have the state card requested. At this time, the requesting player draws a card from the set of remaining cards. The requesting player may then claim any group(s) of cards held in his/her hand. A group of cards is considered a group of a predetermined minimum number of multiple cards representing states on the game board 10 that adjoin one another, e.g. four adjoining states such as Pennsylvania, New Jersey, Delaware and Maryland. The predetermined number may be specified in accompanying instructions or agreed upon by the players in advance. The student takes the group(s) of cards from his/her hand and puts them aside. Optionally, a token is placed on the game board 10 on each of the states of the groups set aside to indicate that those states have been claimed by a player and are no longer available to the other players.

Play then passes (e.g. clockwise) to the next player, who may proceed in a similar manner. Such play continues until a player has laid aside the last of his/her cards in accordance with the rules and no longer holds any cards. A winner may then be determined from the cards laid aside by each player, as discussed in greater detail below. Alternatively, the game ends when no cards remain in the draw deck.

The game board apparatus serves not only an entertainment purpose, as playing the game is fun, but also serves an educational purpose, and thus is well-suited for use as part of an educational curriculum.

Beginner Mode of Play

The Beginner mode of play has a focus of introducing the basics of national geography and map orientation, and thus is an advantageous first step towards playing the game in more advanced modes of play. This mode of play is considered most advantageous for relatively young students, namely those ranging from Kindergarten through Second grade (ages 6-8).

In the Beginner mode of play, play proceeds in a manner similar to that described above. Preferably, two adjoining states are considered a group at this level. In one embodiment, the set of geography playing cards (see FIG. 2), in which each card includes only an image and name of a respective state, is used for this mode of play. In this embodiment, a winner of the game is determined by adding the number of cards, or numbers of groups of cards (as specified in the instructions or determined by the players), laid aside by each player. This requires relatively simple counting/addition skills.

In an alternative embodiment, the electoral college cards (see FIG. 3) is used. In this set of cards, each card includes an image, name, and number of electoral college votes of a respective state. In this embodiment, a winner of the game is determined by summing the number of electoral college votes held by the states represented by the cards laid aside by each player. This requires more sophisticated addition skills, and may be selected when appropriate for the players of a particular game.

Thus, the Beginner mode of play facilitates learning to recognize two-dimensional cartographic outlines of states and the state names, as well as strengthens counting/addition skills. This mode of play also sets into motion the initial stages of comprehension of the geographic relationships among states and regions, and the enormous scale of the continent. Even a pre-school aged child, with the assistance of an older child or adult, can begin to learn what it means to hold a hand of cards and how that establishes her position at the start of play. To begin her orientation, an older child or an adult and child may examine each card in the child's hand, noting the shape and color of each state. The adult may state the name of each state and in turn identify the matching state shape on the game board map. It can be fun and interesting to many children to find the state on the maps. Young children tend to be particularly capable of learning shapes and matching colors. The adults can then share their own hand of cards and identify the states with children.

As a child player begins to be able to identify and locate the states, requests for other states can be made by pointing to a state that shares a boundary with a state in his/her hand. Each time the child chooses a state to work from and organizes requests for boundary states, the adult can help by saying the names of the states. Gradually, through repetitive exposure, the child will learn the name of the state through associated shape and color. It is useful during this stage of learning to point out states where relatives or friends have moved to, or traveled to. Real life events enhance awareness of the structure of the country and the connection we all have with a variety of places outside our own home states or regions. The world begins to open up for the child. From this point, any opportunities to incorporate looking at maps when the family travels by car or other transportation solidifies the child's notion of various point to point connections. The child's personal relationship with and understanding of the geography of the United States grows. As the little one learns more about state shapes and names, it may be appropriate to point out the beginning letter of the states' names to help identify the states. These simple activities form a strong foundation for subsequent learning in school.

Intermediate Mode of Play

The Intermediate mode of play focuses on teaching electoral college concepts and information, including the number of electoral college votes to which each state is entitled. This mode of play is considered most advantageous for relatively young students, namely those ranging from Third grade through adulthood (ages 8+).

In the Intermediate mode of play, play proceeds in a manner similar to that described in the Overview above, and the set of state cards shown in FIG. 3 are used for this mode of play. Preferably, four adjoining states are considered a group for this mode of play. Each player sums the total number of electoral college votes held by each state represented by cards the player has laid aside. The player with the highest total of electoral college votes is determined to be the winner. This strengthens each player's addition skills.

Trial and error strategies are used predominantly at the beginning of the game. Players rapidly gain some information about the cards in others' hands indicated by which states other students have sought during their turns, which encourages memorization and memory stimulation. Plans evolve based on what other students might hold. Possibilities of others' holdings are revealed because students must ask for states that are positioned on the map in locations that are adjacent to, i.e. border, states represented by cards they hold in their hands.

Even young students quickly realize the advantage of obtaining cards representing states having greater numbers of electoral college votes. This becomes the motivation to learn which states have relatively higher populations, more electoral college votes, etc. This requires that each student learn/memorize such information, because such information is not plainly visible/printed on the game board itself. Curiosity will often spark questions relating to the assignment of the numbers of members in the Senate and House of Representatives as well as the important role of the census in this process.

At this level the importance of deductive reasoning, memory and hypothesis generation become significant and can present excellent practice for school-aged children. These skills may be applied to innumerable tasks children will later face in school and throughout their adult lives. The game allows for practice of these skills in the context of an interesting game, which is advantageous for teachers and parents. This is also the age group that will benefit greatly from the opportunity to practice some basic social skills including the skills of self-control and patience. These are skills that are less able to be practiced through many computer activities. Practicing the skills of courtesy in the midst of competition is also a very important set of social skills children may develop through play of the game.

States clustered in geographic regions are identified easily. Differences in concerns in different parts of the country begin to be clearer as children play. Discussions can stem from observations of the contrast of state sizes on the east coast, in the plains, and the west coast. Knowing the geography supports understanding of differences in states' historical and regional concerns that are reflected in voting trends. The story of the settlement of the United States is reflected in language, arts, and architecture as well as political alliances and competition between regions. When children hear stories on the news, read books, or hear of travels of friends and relatives, they understand where the events are taking place. Local traditions and cultural influences become more meaningful and are identified more easily by children. The unique character of being a United States citizen with a state identity as well as a national identity often becomes an enriching dynamic for children of this age. By learning the states' connections, children tend to absorb and organize incoming information from other parts of their world and place it in a context of an understanding of the structure of the country itself.

Advanced Mode of Play

The Advanced mode of play has a focus on teaching state and state capital information, and electoral college concepts and information. Accordingly, this mode of play establishes an increasingly detailed knowledge of the United States and its geography. To that end, it is preferred to use a game board that is similar to that shown in FIG. 1, but that omits the names of the state capitals. This may be provided by a separate game board, or as an overlay that provides the names of the capitals for the states. Instead, the respective state capitals are identified on each of the cards of the set of electoral college cards, as shown in FIG. 3.

This level is considered most advantageous for relatively advanced students and adults, namely those ages 9 and above, which are beyond the Third grade.

In the Advanced mode of play, play proceeds in a manner similar to that described above with reference to the Overview, and the set of electoral college cards including the cards shown in FIG. 3 are used for this mode of play. Preferably, four adjoining states are considered a group for this mode of play. Each player sums the total number of electoral college votes held by each state represented by cards the player has laid aside. The player with the highest total of electoral college votes at the end of the game is determined to be the winner. This strengthens each player's addition skills.

Play is very similar to that described with reference to the Intermediate mode of play, except that requesting of cards, and thus possession of the electoral votes, is accomplished not simply by asking for states by name but by seeking states by asking for a named state having a named state capital. Players may ask only for capitals of states that are adjacent on the game board, i.e. border, states represented by cards held in the player's hand. For example, if a player holds a card representing Oklahoma, the player may make a request by stating "Jenny, give me Texas' Austin." Because the capital information is not printed on the map, the state/state capital pairs must be retrieved from each individual player's memory. This fosters learning of state and state capital information, In addition, in this Advanced mode of play, there is an added aspect of challenge and penalty. The request must be for the correct state and capital for the requester to earn the requested state card. However, when a student asks for a state capital no cues are available in his or her hand, or on the game board, to tell him or her if he or she asked for the correct capital, even if the bordering state is correct. If in the example, a student requests "Texas' Houston" that student would have incorrectly named Texas' capital and would not have earned the requested card. If any other student holds the Texas card and therefore knows the correct capital because it is printed on the Texas state card, he or she has an option of remaining silent or challenging, by pointing out the other student's error. For example, the student holding the Texas card may say "You are lost in Texas and I can prove it." The requesting student loses a predetermined number of points, e.g. 10 points, from the final electoral vote tally. However, by pointing out the error, the challenging student reveals that she holds the Texas card in her hand. The challenging student considers whether the advantage of penalizing the requesting student is worth the disadvantage of revealing her holding of the Texas card. This will generally depend on the stage of the game. If a student is penalized with point deductions, it may be listed on a score sheet. The total penalty score is subtracted from the total electoral votes tally to obtain each student's final score. A winner of the game is determined by comparing each player's final score and determining which player has the highest score.

If the requesting student makes an error and no one holds Texas and corrects the student, any student that knows the correct capital but does not hold the card has an advantage. The incorrect information may be used by other students giving the now knowledgeable student information about others' hands and the potential to ask for and obtain the Texas card with the correct capital later in the game. This enhances strategic thinking and encourages independent study of the states' capitals in preparation for play.

Deductive reasoning, attention, and memory are used to develop hypotheses about other students' hands. As students gain experience in playing the game, these skills develop and strengthen. Having each student be responsible for adding the electoral votes they acquire improves simple addition and subtraction skills. Speed and accuracy improve with practice. Children may find competition in trying to complete their addition tasks first. Teachers may choose to implement systems of small forms of reinforcement for highest scores and/or fast and accurate addition, shaping student performance to achieve higher levels of accomplishment. The social skills practiced with this exercise set up also enhance learning and development. Immediate social exchanges help youngsters to practice turn-taking skills, listening skills, sustained attention, and patience. The social setting of the board format makes it ideal to use in the classroom and with almost everyone over six years old within a family.

Historical Mode of Play

Another mode of play is the Historical mode of play, which focuses on teaching historical information, including a historical perspective on the role and impact of the electoral college system throughout U.S. history. This mode of play is structured as the Intermediate mode of play referred to above. However, in addition to those aspects of play described above, the Historical mode of play involves playing of the game in the context of a particular election year in which the configuration of states and/or electoral college votes is other than it is in the present, i.e. other than it is with reference to the main game board and related set of cards.

FIG. 4 is a plan view of an exemplary game board overlay used in conjunction with the exemplary game board of FIG. 1 during a Historical mode of play in accordance with the present invention. More specifically, a plurality of historical map overlays, each with a corresponding set of historical playing cards, is provided. Each overlay is configured to identify which states are available, and which states are unavailable, for a round of play. In essence, the overlay customizes the more recent map to a previous historical time period so that after application of the overlay, only those states that were members of the union in the corresponding election year are available to be claimed in the round of play. By way of example, each overlay may be provided to include a shaded transparency, e.g. on a cardboard frame sized to match the game board. The shading may cover states that are available, or states that are unavailable. Alternatively, the overlay may be provided as a plurality of separate opaque tiles that are positionable to obscure selected states so that in combination they identify which states are available for the round of play. Preferably, each overlay corresponds to a distinct, historically significant era. By way of example, a respective historical map overlay is provided to illustrate the composition of states of the United States during the elections of 1788, 1812, 1860, 1900, and 1948. Corresponding sets of historical cards accurately reflecting the electoral college votes and/or state capitals are also provided.

The variations among these election years enhance study of these periods of American history, as well as provide a historical perspective on the role and impact of the electoral college system throughout U.S. history. The historical map overlays for each of the elections represented illustrate the makeup of the country at the time. The set of historical state cards corresponding to the year of the historical map overlay is used. It is recommended that the following adjustments to the standard procedure for the specific dates chosen for the curriculum plan. The number of players and/or adjoining states required to constitute a group may be altered as desired based on the number of states in a given year. Play proceeds generally as described above after placing a map overlay, e.g. that for the year 1788, over the main map board so that the only the states shown are those that were afforded state status as of 1788. The corresponding set of cards showing the appropriate numbers of electoral college votes is used.

Exemplary Game Play

Figure 12:
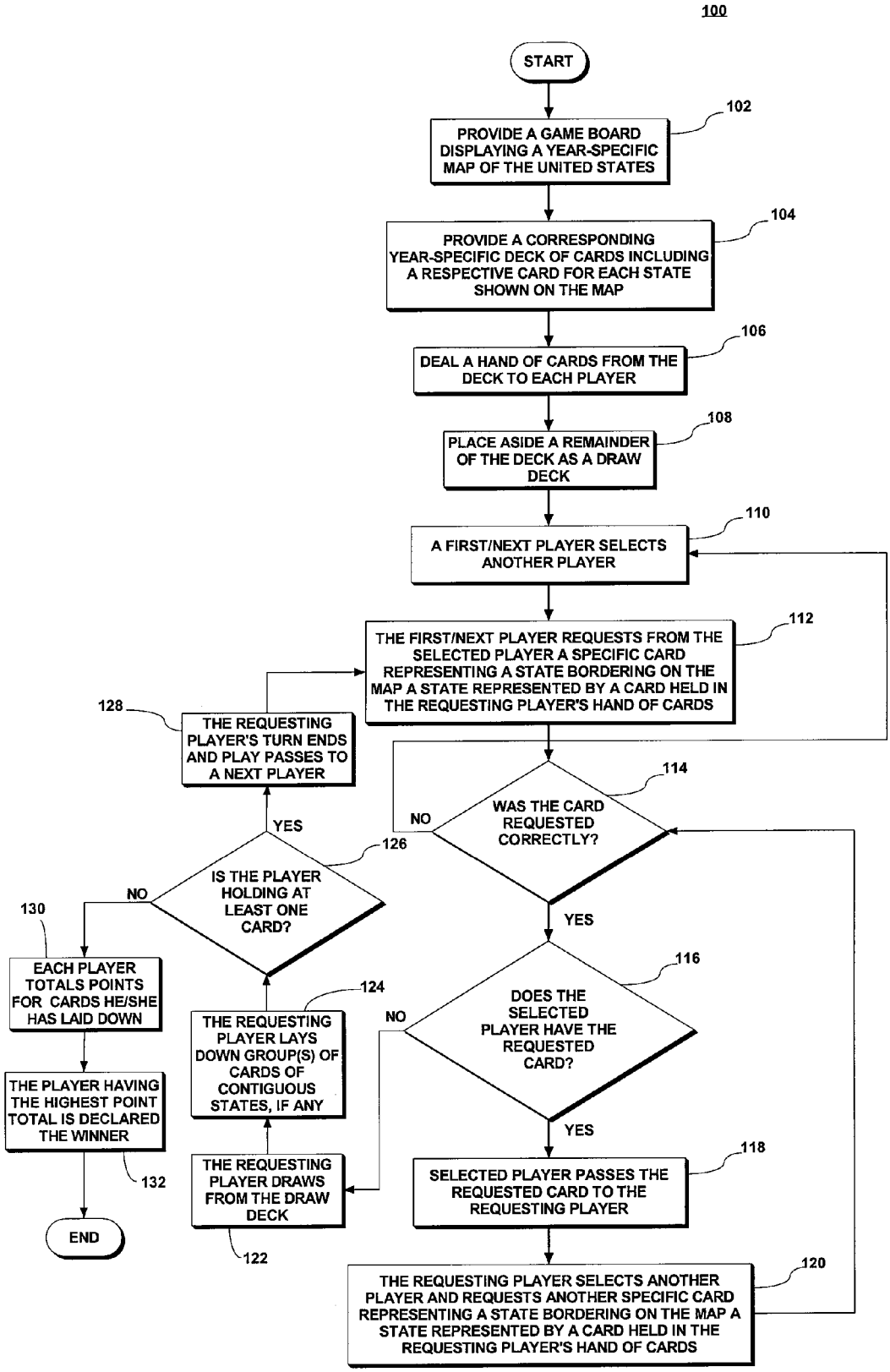
FIG. 12 is a flow diagram illustrating an exemplary method of play of the game of FIGS. 1-11.

FIG. 12 is a flow diagram illustrating an exemplary method of playing a game in accordance with one embodiment of the present invention. As shown in FIG. 12, play generally begins with providing of a game board displaying a year-specific map of the United States, as shown at step 102. For example, this may involve removing the game board 10 from a box, placing it face up on a table, and optionally providing a historical map or state capital overlay that, combined with the game board 10, provides a game board for the purpose of a particular round of play. The combination of the game board can, and any optional overlay establishes the year-specific map for the round of play.

Next, a corresponding year specific deck of cards is provided, showing a step 104. For example, this may involve removing and/or selecting a set of cards from one of the set of cards in the box. Any one of the geography playing cards, electoral college playing cards or historical state playing cards may be selected, provided that it is consistent with the game board that has been set up for this particular round of play.

One of the players then deals a hand of cards to each player from the card deck selected in step 104, as shown that 106. The number of cards for a complete hand of cards may be specified in accompanying instructions provided in the game box.

The remainder of the deck of cards is then placed aside, e.g. on the game board, to be used as a draw deck from which additional cards may be drawn by the players, as shown at step 108.

The first player, e.g. the player to a left of the dealer, has a turn. That player then selects another player, as desired, as shown at step 110. The first player than requests from the selected player, a specific card representing a state that shares a border on the map, as shown on the game board, with a state represented by a card held in the requesting players hand of cards, as shown at step 112. The manner in which the card is requested is a function of the desired mode of play, as described above. For example, the state may be requested by its name, by the name of its capital, etc.

In a motive play in which challenge is permitted, it is determined whether the card was requested correctly, has shown at step 114. Challenge may proceed as described above, if permitted for the mode of play. If the card was not requested correctly, play proceeds to the next player. Alternatively, the requesting player may be required to first draw a card from the draw deck.

If the card was requested correctly and the selected player has the requested card, as shown at step 116, than the selected player passes the requested card to the requesting player, as shown at step 118. The requesting player may then select the same or another player and request another specific card, in a similar manner, as shown at steps 120 and 114. This continues until the selected player does not have the requested card.

If it is found that the selected player does not have the request card in step 116, then the requesting player draws a card from the bee draw deck, as shown at step 122. Requesting player may then lay down any groups of cards filled in his hand. Groups of cards are defined according to predetermined rules, e.g., as provided in accompanying instructions. Exemplary group definitions are provided in the exemplary modes of play described above.

If the requesting player still holds at least one card than the requesting player's turn ends, and play passes to a next player in round robin fashion, e.g. the next player to the left of the preceding player, as shown at steps 126, 128 and 112.

If the requesting player no longer holds at least one card, i.e., the requesting player has laid down all of his cards in groups in step 124, then play of the game ceases, and each player totals points for the card he or she has laid down, shown at steps 126 and 130. Points are determined in accordance with the rules for the particular mode of the leading for the completed round. Exemplary rules for determining points, e.g. by adding the number of cards, states, groups, or electoral college votes, are described above in connection with the exemplary modes of play.

The player having the highest point total is declared the winner in the game ends, shown at step 132.

DISCUSSION

Generally, by being exposed to various state cards in their hands, children may see the states and the country in an entirely new, quite sophisticated way. This understanding lends itself beautifully to important current events, especially around election season and census taking time. Adults generally benefit from being reminded of the details. Immigrant groups seeking citizenship can benefit from this entertaining method of learning United States geography and election process principles.

Generally, the Beginner mode of play offers the following learning objectives: learning to recognize the 48 continental states; learning the states' geographic neighbors; practicing basic counting skills; and recognizing their home states and explore where other important people in their lives live to develop a personally relevant and meaningful sense of the geography of this vast nation.

Further, the Beginner mode of play allows players to achieve cognitive skills development objectives, such as practicing attention and concentration skills through a motivating activity, practicing memory skills, and practicing planning skills incorporating elementary deductive reasoning strategies.

Further still, the Beginner mode of play allows players to achieve social skills learning objectives, such as practicing patience and waiting skills, practicing listening skills, and practicing sharing and relinquishing within the rules of fair play.

The Intermediate mode of play offers the following learning objectives: learning the geography of the states of the continental United States; understanding the basic concepts of how the electoral college works in electing the president; understanding the importance of the census in determining the distribution of electoral college votes to states; understanding the relative importance of states' populations and associated desirability in the election of the president; improving addition skills; and being introduced to basic concepts of geographic influences on regional differences and concerns.

Further, the Intermediate mode of play allows players to achieve cognitive skills development objectives, such as increasing attention and concentration skills, developing skills of deductive reasoning, practicing memory skills, and practicing basic strategic planning skills.

The Advanced mode of play allows for learning the capitals of the 50 states in the Union while allows players to achieve cognitive skills development objectives, such as increasing attention and concentration skills, developing skills of deductive reasoning, practicing memory skills, and practicing basic strategic planning skills.

Further, the game apparatus described herein is useful in teaching geography and social studies in the era of the "No Child Left Behind" legislation of 2001, and the update of the 1965 Elementary and Secondary Education Act, which are intended to close the achievement gap that currently exists between higher-achieving and lower-achieving schools in the United States. Addressing the range of demands and diverse needs of student populations present great challenges within the process of teaching. Legislative requirements have increased pressure on teaching approaches and curriculum development across the country. Incorporating teachers' creativity and individual styles in the classroom are increasingly important to enrich students' learning experience and supporting feelings of curiosity and excitement in the classroom.

The National Assessment Governing Board of the National Assessment of Educational Programs has developed a geography assessment plan organized around two primary dimensions, the content and the cognitive. The framework proposes three aspects of content: space and place, environment in society, and special dynamics and conditions. Three aspects of the cognitive dimension are proposed: knowing, understanding, and applying (at this time these constructs are being used on a trial basis.) All combinations of the six aspects of the content and cognitive dimensions will be tested on examinations. The potential number of items of information that could be taught within the framework description to prepare for the schools evaluations is enormous.

Trying to learn the multitude of possible bits of information is daunting. The game apparatus provides a teaching tool that allows flexible presentation of a variety of inter-related United States social studies content areas and concepts that can be used in elementary—through middle-school grades. The game apparatus presents the basics of United States geography as well as advanced concepts such as United States population distribution and its relationship to electoral politics in a single entertaining educational game. Thus, it is able to provide an important teaching option to enhance the learning experience of students from the elementary years through middle school. The game apparatus also complies with and supports the curriculum standards of the National Council for Social Studies to achieve academic competence in grades K-12. The materials allow teachers to develop creative interactive learning units within clear approaches to evaluate student learning and mastery. An added bonus is the teaching model sets the stage to be fun for students and can be used as a reward following more traditional teaching presentations. It is hoped that teachers will find the game apparatus an entertaining as well as valuable addition to the geography curriculum.

Further, it will be noted that the game play of the present invention may be implemented as a computer game played on a general purpose computer. By way of example, the computer programming code may be embodied in computer readable media capable of configured a general purpose personal computer to implement some of all of the game play methodology described above. By way of example, the maps and a player's "hand" of "cards" may be presented on a computer display monitor while individuals play the game as described above. In one embodiment, a human may play against a computer, which will play the game in substitute for one or more other human players, as generally known in the art. Alternatively, the game may be configured to be played by multiple human players operating computer communicating via a computerized communications network, as generally known in the art.

While there have been described herein the principles of the invention, it is to be understood by those skilled in the art that this description is made only by way of example and not as a limitation to the scope of the invention. Accordingly, it is intended by the appended claims, to cover all modifications of the invention which fall within the true spirit and scope of the invention.

What is claimed is:

1. A game apparatus comprising:

a game board displaying a United States map for a particular year, said map showing each state as defined by its respective border, said game board excluding any visible indication of any number of electoral college votes corresponding to any state;

at least one historical map overlay corresponding to a respective election year and being configured to mark as available a selected subset of states shown on the game board, the subset comprising only states that were members of the United States during the respective election year; and a set of historical playing cards corresponding to each historical map overlay, said set of historical playing cards comprising one card for each state marked as available by the corresponding historical map overlay, each card of said set of historical playing cards displaying: (a) an image of a respective state and/or text indicating the respective state's name; and (b) numerical indicia indicating a respective number of electoral college votes held by the respective state during said respective election year.

2. The game apparatus of claim 1, wherein said at least one historical map overlay further comprises indicia identifying said respective election year.

3. The game apparatus of claim 1, wherein each card of said set of historical playing cards displaying further indicia identifying said respective election year.

4. The game apparatus of claim 1, wherein each card of said set of historical playing cards displaying further text indicating a name of the respective state's capital.

5. The game apparatus of claim 1, wherein said historical map overlay comprises a sheet of transparent material bearing printing thereon, said printing shading one of a set of available states and a set of unavailable states, said sheet being sized to correspond to dimensions of said game board.

6. The game apparatus of claim 1, wherein said historical map overlay comprises a set of opaque tiles, each tile of said set of opaque tiles being shaped to obscure at least one state shown on said game board.

7. The game apparatus of claim 1, further comprising a plurality of tokens for marking states as unavailable, and a plurality of pre-printed score sheets, each comprising a printed grid to be used in tallying a score.

8. A game apparatus comprising:

a game board displaying a United States map for a particular year, said map showing each state as defined by its respective border, said game board excluding any visible indication of any number of electoral college votes corresponding to any state;

a set of electoral college playing cards, said set of electoral college playing cards comprising one card for each state shown on said game board, each card of said set of electoral college playing cards displaying an image of a respective state, text indicating said respective state's name, and numerical indicia indicating a number of electoral college votes held by said respective state during the particular year;

a set of geography playing cards, the set of geography comprising one card for each state shown on said game board, each card of said set of geography playing cards displaying an image of a respective state and text indicating said respective state's name;

a plurality of historical map overlays, each of said historical map overlays corresponding to a respective election year, each of said plurality of historical map overlays being configured to mark as available a selected subset of states shown on the game board, the subset comprising only states that were members of the United States during the respective election year; and a set of historical playing cards corresponding to each of said plurality of historical map overlays, said set of historical playing cards comprising one card for each state marked as available by the corresponding historical map overlay, each card of said set of historical playing cards displaying an image of a respective state, text indicating the respective state's name, and numerical indicia indicating a respective number of electoral college votes held by the respective state during said respective election year.

9. The game apparatus of claim 8, wherein said historical map overlay comprises a sheet of transparent material bearing printing thereon, said printing shading one of a set of available states and a set of unavailable states, said sheet being sized to correspond to dimensions of said game board.

10. The game apparatus of claim 8, wherein said historical map overlay comprises a set of opaque tiles, each tile of said set of opaque tiles being shaped to obscure at least one state shown on said game board.

11. A method of playing a board game comprising:

providing a game board displaying a United States map for a particular year, said map showing each state as defined by its respective border, said game board excluding any visible indication of any number of electoral college votes corresponding to any state;

placing a historical map overlay for a respective election year over said game board, providing a set of historical playing cards corresponding to each historical overlay, said set of historical playing cards comprising one card for each state marked as available by the corresponding historical map overlay, each card of said set of historical playing cards displaying: (a) an image of a respective state, and/or (b) text indicating the respective state's name; and numerical indicia indicating a respective number of electoral college votes held by the respective state during said respective election year;

distributing cards from said set of historical playing cards to provide a respective hand of cards for each of a plurality of players, and a draw deck comprising a remainder of said set of historical playing cards;

passing play among the players in round-robin fashion, each player in turn:

requesting from another selected player a specific card representing a state that shares a border on said map with a state represented by a respective card held in the player's hand of cards, and receiving the requested card from the other player, until the selected player does not have the requested card;

drawing a next card from the draw deck; and laying down a group of cards representing a predetermined number of contiguous states, if any; and if any player no longer holds any cards:

each player summing the respective player's points as represented by cards laid down by the player; and declaring as a winner a respective player having a highest number of points.

12. The method of claim 11, wherein summing the respective player's points comprises summing the numbers of electoral college votes displayed on the cards laid down by the respective player.

13. The game board apparatus of claim 1, further comprising printed instructions including text describing play of a game in accordance with the method of claim 11.

* * * * *